United States Patent [19]

Ritzerfeld

[11] 3,995,546

[45] Dec. 7, 1976

[54] ROTARY DUPLICATING MACHINE

[76] Inventor: Gerhard Ritzerfeld, Schorlemer Allee 14, 1000 Berlin 33, Germany

[22] Filed: Dec. 10, 1975

[21] Appl. No.: 639,229

Related U.S. Application Data

[63] Continuation of Ser. No. 347,920, April 4, 1973, abandoned.

[30] Foreign Application Priority Data

Apr. 18, 1972 Germany ..... 2219489

[52] U.S. Cl. ..... 101/91; 101/132.5

[51] Int. Cl.[2] ..... B41L 47/46

[58] Field of Search ..... 101/91, 92, 132, 132.5, 101/141, 145, 93.03

[56] References Cited

UNITED STATES PATENTS

| | | | |
|---|---|---|---|
| 2,868,116 | 1/1959 | Ritzerfeld et al. | 101/91 X |
| 2,868,117 | 1/1959 | Ritzerfeld et al. | 101/91 X |
| 2,967,477 | 1/1961 | Ritzerfeld et al. | 101/91 X |
| 3,155,036 | 11/1964 | Ritzerfeld et al. | 101/91 X |
| 3,238,868 | 3/1966 | Ritzerfeld et al. | 101/91 |
| 3,489,081 | 1/1970 | Ritzerfeld | 101/91 |

OTHER PUBLICATIONS

Bear et al., IBM Technical Disclosure Bulletin, vol. 5, No. 11, Apr. 1963, pp. 27–29.

*Primary Examiner*—Edward M. Coven
*Attorney, Agent, or Firm*—Michael J. Striker

[57] ABSTRACT

A rotary printing roller supports a printing form and a rotary counter-pressure roller is adjacent the printing roller. One of the rollers is movable to and from a printing position in close proximity to the other roller to define with the same a printing line. A plurality of cams are provided which are selectably shiftable into and out of connection with an arrangement which effects movement of the movable roller to and from the printing position. Depending upon which of the cams is associated with this arrangement, sections of different width of the printing form will pass through the printing line as the printing roller turns through an angle dependent upon the respective cam. The cams are moved to the position cooperating with the aforementioned arrangement by means of electromagnets which are selectively energizable, and are restored to their starting position by the arrangement which displaces them mechanically.

4 Claims, 6 Drawing Figures

1
2
3
4
5
6
7
8
9
12
13
14
15
16
17
18
19
21
22
23
24
25
26
26a
26a'
26b
27
28
29
30
31
35
40
41
42
43
47
48
49
50
51
52
54
C

ROTARY DUPLICATING MACHINE

This is a continuation of application Ser. No. 347,920, filed April 4, 1973, now abandoned.

BACKGROUND OF THE INVENTION

The present invention relates generally to a rotary duplicating machine, and more particularly to a rotary duplicating machine which is capable of printing individual lines of a printing form mounted on the printing roller of the machine.

Rotary printing rollers are already known, for instance from U.S. Pat. No. 2,967,477, in which the selection of particular lines of groups of lines of the printing form which are to be printed during a given rotation of the printing roller is carried out by means of cams which control the movement of the printing roller or the counter roller into or out of printing engagement with one another, and which in turn are controlled by electromagnets which move the cams into or out of a position in which they can control the movement of the respective roller. In these constructions the electromagnet must be very strong in order to obtain the proper movement of the respective cam. These relatively strong electromagnets are, however, to slow to provide for the necessary rapidity of the cam-shifting movement to thereby in turn effect relative shifting of the printing roller and the counter-pressure roller. This necessitates the utilization of relatively complicated and expensive secondary devices, such as impulse storage devices or the like.

SUMMARY OF THE INVENTION

It is a general object of the present invention to overcome the aforementioned disadvantages of the prior art.

More particularly it is an object of the present invention to provide a rotary duplicating machine which is not possessed of these disadvantages.

Still more particularly it is an object of the invention to provide such a rotary duplicating machine, in which a rapid displacement of the cams into and out of operative position can be effected, within the time period available for such displacement, and utilizing only relatively low-strength electromagnets. This provides for a more reliable and economically more attractive solution to the problem.

In keeping with the above objects, and with others which will become apparent hereafter, one feature of the invention resides, in a rotary duplicating machine, in a combination which comprises rotary printing roller means for supporting a printing form, and rotary counterpressure roller means. One of these roller means is movable to and from a printing position in close proximity to the other roller means and defines with the same a printing line. Operating means is connected to the movable roller means for moving the same to and from the printing position. Control means is provided, including a plurality of cams selectably shiftable into and out of association with the operating means. Different ones of the cams are operative for actuating the operating means to move the movable roller means to its printing position while the printing roller turns through respective different angles so that sections of different widths of the printing form pass through the printing line in dependence upon which of the cams is associated with the operating means. Actuating means is associated with the control means and includes biasing means permanently tending to shift the cams into association with the operating means. Abutment means is moved both to and from a blocking position blocking the movements of the cams, and electromagnetic means is responsive to triggering signals originating during the turning of the printing roller means to move the abutment means away from its blocking position. Restoring means restores the abutment means to the blocking position and thereby causes the cams to be shifted out of association with the operating means.

The novel features which are considered characteristic for the invention are set forth in particular in the appended claims. The invention itself, however, both as to its construction and its method of operation, together with additional objects and advantages thereof, will best be understood from the following description of specific embodiments when read in conjunction with the accompanying drawing.

DESCRIPTION OF THE PREFERRED EMBODIMENTS

Figure 1:
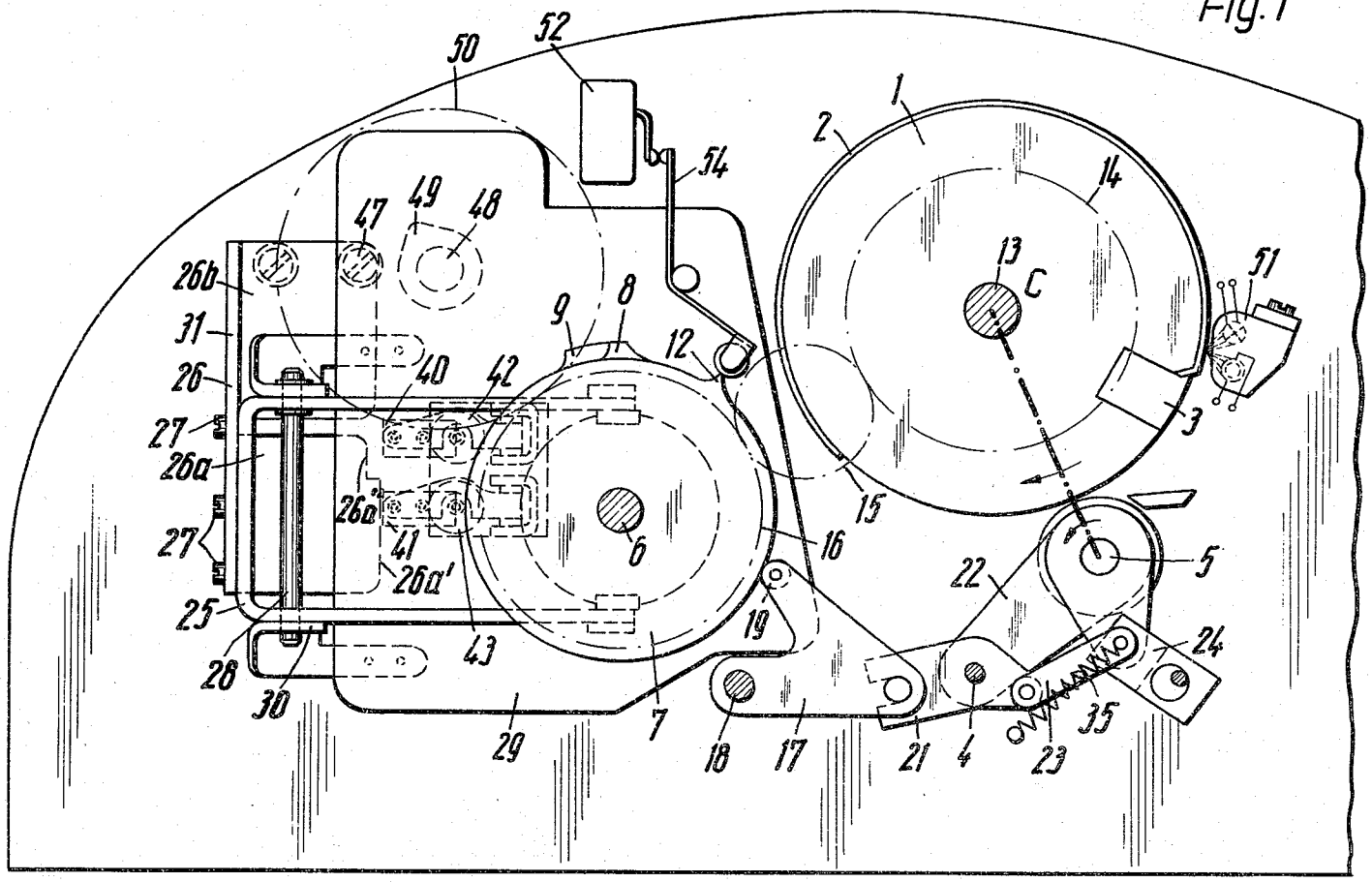
FIG. 1 is a somewhat diagrammatic side view of a rotary duplicating machine in accordance with the invention.
Figure 2:
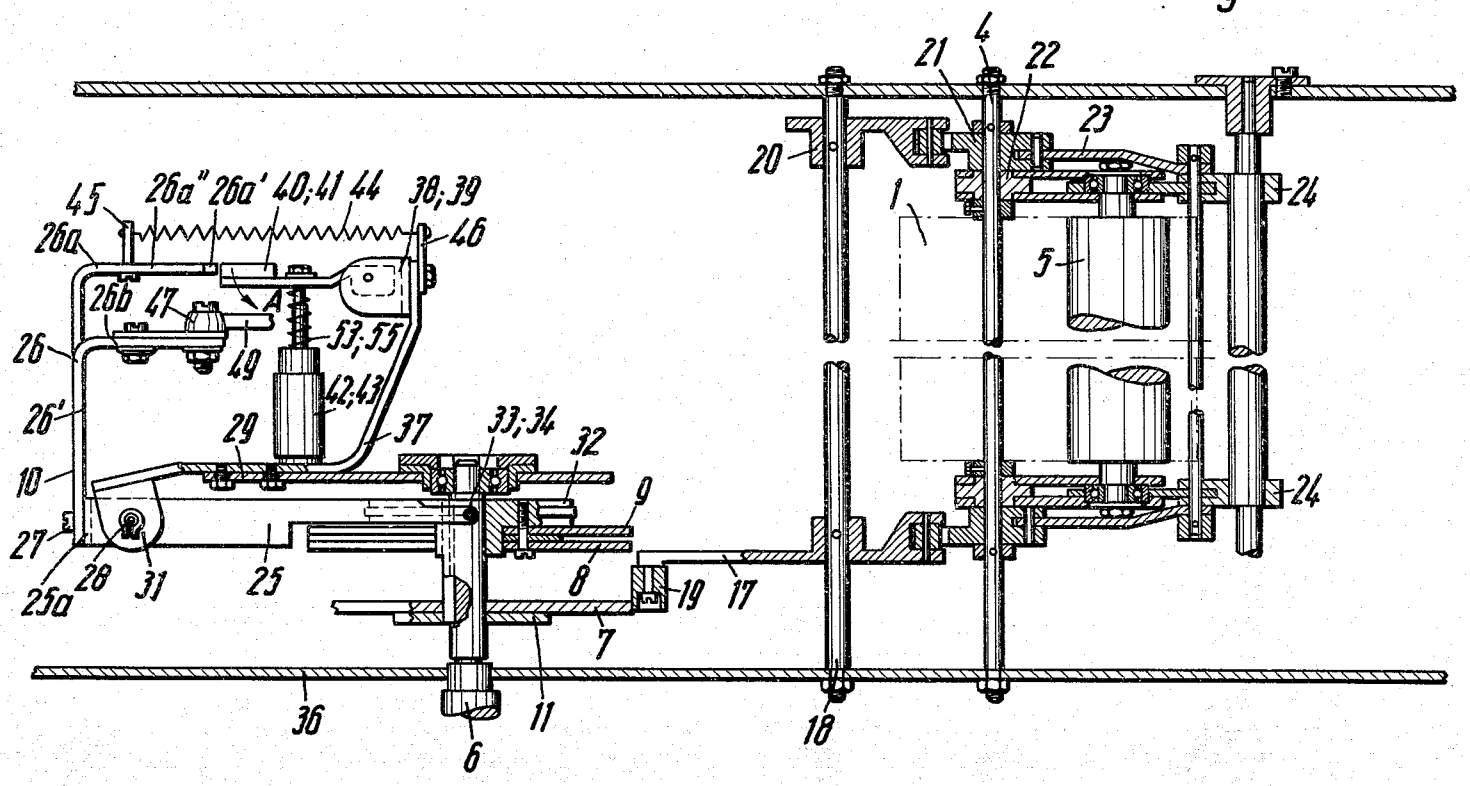
FIG. 2 is a top-plan view of FIG. 1 partially sectioned and exploded.
Figure 6:
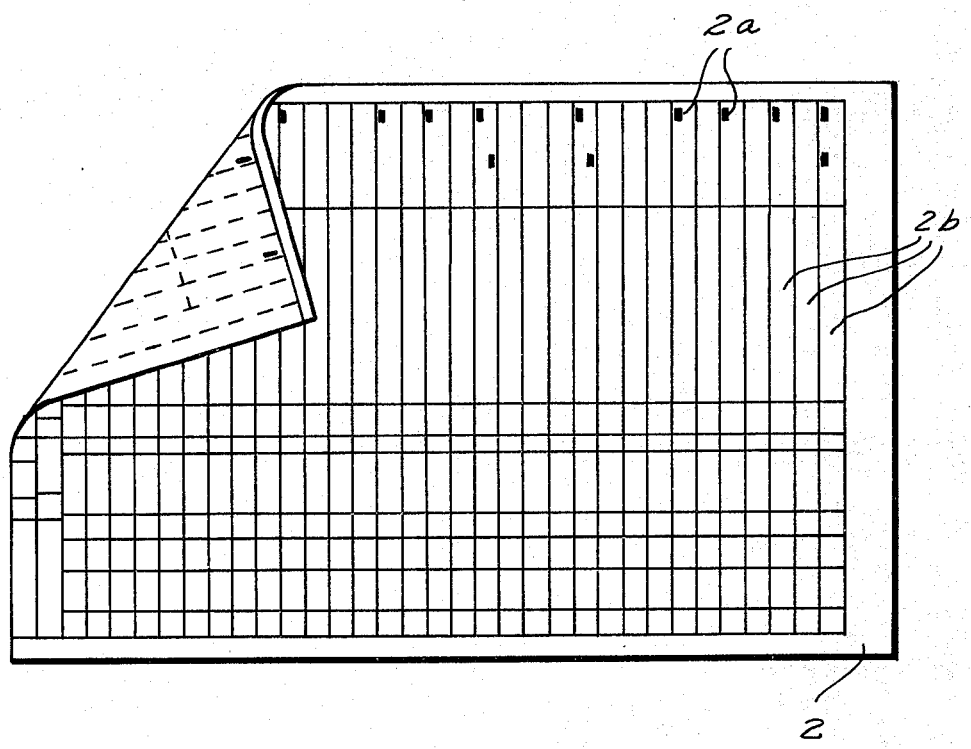
FIG. 6 is a top view of a printing form for use with the machine of FIGS. 1–5.

Discussing the drawing now in detail, and firstly referring to FIGS. 1–2 thereof, it will be seen that FIG. 1 identifies a rotary duplicating machine having a printing or duplicating roller 1 which is adapted to support and carry a printing form or master sheet 2 having indicia **2*a* thereon in respective ones of its lines 2*b*, as shown in FIG. 6. A known clamping arrangement 3 holds the printing form 2 on the roller 1. The counterpressure roller 5 is provided which will be pivoted into and out of printing engagement with the periphery of the printing roller 1 about an axis 4, and the movement into and out of engagement with the printing roller 1 is controlled by control cams 7, 8 and 9 which are mounted on a shaft 6 on which they can be axially shifted by means of a control device 10. Depending upon te extent to which these cams are shifted in axial direction on the shaft 6, they will control the movement of the roller 5 relative to the roller 1**.

Cams 7, 8 and 9 are configurated so as to have circumferentially extending cam tracks of different length. The cam 7 has two cam portions one of which controls the printing of the first line of the printing form and the second of which is designated with reference numeral 12 (see FIG. 1) and cooperates with an arm 54 which will be discussed subsequently. Cam 7 is fixedly connected with the shaft 6 against rotation relative thereto, by means of a flange 11 as shown in FIG. 2.

The cams 7, 8 and 9 must be rotated in synchronism with the printing roller 1. To assure this, the shaft 6 is rotated via a gear train 14, 15 and 16 which is driven by the shaft 13 on which the printing roller 1 is mounted for rotation.

A cam follower 17 is provided which is mounted for pivotal displacement on a shaft 18 and cooperates with the cams 7, 8 and 9. The cam follower 17 has a cam follower roller 19 on which the cam tracks of the cams 7, 8 and 9 act, depending upon the position in which the cams are located. Because of the different lengths of the cam tracks of the different cams, cam follower 17 which transmits its movement via an intermediate arm 20 (see FIG. 2) and an articulated transmission having the components 21–24 to the counterpressure roller 5—moves the latter into and out of the engagement with the rotary printing roller 1 in a rhythm and for time periods controlled by the cam tracks. After printing of a line or series of lines has taken place, the counter-pressure roller 5 is moved out of engagement with the printing roller 1 by the action of the return spring 35.

Coming now to FIG. 2 in particular it will be seen that the axial displacement of the cams 8 and 9, that is their movement into or out of engagement with the cam follower roller 19, is controlled via the control device 10. The latter utilizes a U-shaped bracket 25 of advantageously rectangular cross-section, and an angle piece 26 the longer arm 26' of which is connected to the bracket 25 at the location 25a by means of screw or bolts 27. A shaft 28 is provided on which the bracket 25 is turnably mounted and which carries on its opposite ends mounting members 30 and 31 which are engaged by a wall 29. A groove of the flange 32, which supports the cams 8 and 9, has a pin 33, 34 of the bracket 25 extend into it, so that as shown in FIG. 2 the bracket 25 is connected with the cams 7, 8 and 9 and can thereby effect shifting of the same in axial direction on the shaft 6.

It will be appreciated that the wall 29 must be maintained stationary. For this purpose it is connected in a manner not separately illustrated in the drawing with a side wall 36 of the duplicating machine. A further angle bracket 37 is mounted on the wall 29 and it carries at its free end two mounting members 38 and 39 which are located one above the other with a certain spacing. Abutments 40 and 41 are pivoted to the mounting members 38 and 39, respectively, and can be moved in the direction of the arrow A (see FIGS. 1 and 2) in response to energization of electromagnets 42 and 43 mounted on the wall 29. Portion **26*a* of the bracket 26 has the brokenline contour shown in FIG. 1 and is located opposite the abutments 40 and 41. The latter abutment is drawn by a spring 44 (see FIG. 2) against the side 26*a'* of the portion 26*a*, and the spring 44 will be seen to be connected at the side 26*a''* of the portion 26*a* by means of a pin 45, and to the free end of the bracket 37 by means of a mounting member 46. An additional portion 26*b* of the mounting member 26 has the broken-line contour which is also shown in FIG. 1 and carries a slightly projecting roller 47 which cooperates with a projection 49 mounted on a shaft 48. The latter is driven via a qear 50 that is mounted on the shaft 48 and meshes with the gear 16, so that the projection 49 rotates in synchronism with the printing roller 1.**

The operation of the duplicating machine will now be described.

The cam 7 should be rotated in stepwise manner by a non-illustrated arrangement which is known per se and which may be of the type disclosed in the aforementioned U.S. Pat. No. 2,997,949. In so doing the projection 12 acts upon the arm 54, which is a spring arm engaging an actuating member of the illustrated microswitch 52. The microswitch 52 in turn is connected with a photoelectric sensing device 51 of known construction which scans and senses (in a manner to be described later with respect to FIG. 5) respective ones of the indicia **2*a* provided on the printing form 2 and indicative of the second and third printing line thereon. On detection of these indicia 2*a* the device 51 produces a signal which is applied to the electromagnet 43, energizing the same with the result that it pivots the abutment 41 in the direction A. The actuation of the magnet 43 is opposed by the force of the spring 53 which is provided on the magnet armature 43*a* and connected with the abutment 41.**

It will be appreciated that before the abutment 41 can be displaced by the magnet 43 in the above manner, it is first necessary to lift the abutment 41 somewhat out of engagement with the portion **26*a'* against which it is urged by the spring 44; otherwise, the magnet 43 could not properly operate it. This lifting-off is caused by the engagement of the projection 49 with the roller 47 during rotation of the shaft 48, whereby the device 10—that is the portion 26*a'* thereof—is slightly lifted out of engagement with the abutment 41 so that the latter can readily be displaced by the energized magnet 43.**

Figure 3:
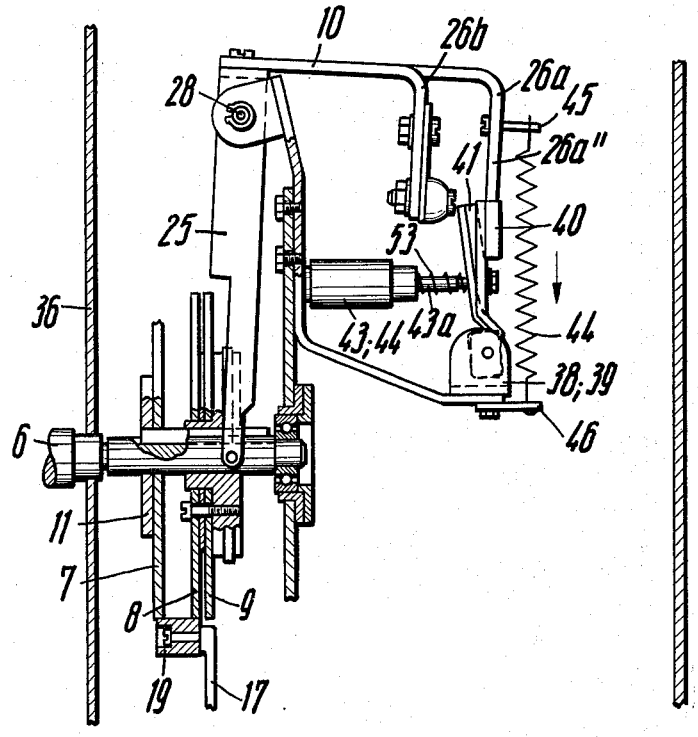
FIG. 3 is a fragmentary top-plan view of a portion of FIG. 2, illustrating the cams in the position they assume when a first and a second printing line are to be printed.

FIG. 3 shows that the spring 44 moves the device 10 so that the portion **26*a''* moves into engagement with the fixed abutment 40, so that the cam 8 is moved into contact with the follower roller 19,** whereby the second printing line is set for printing.

Figure 4:
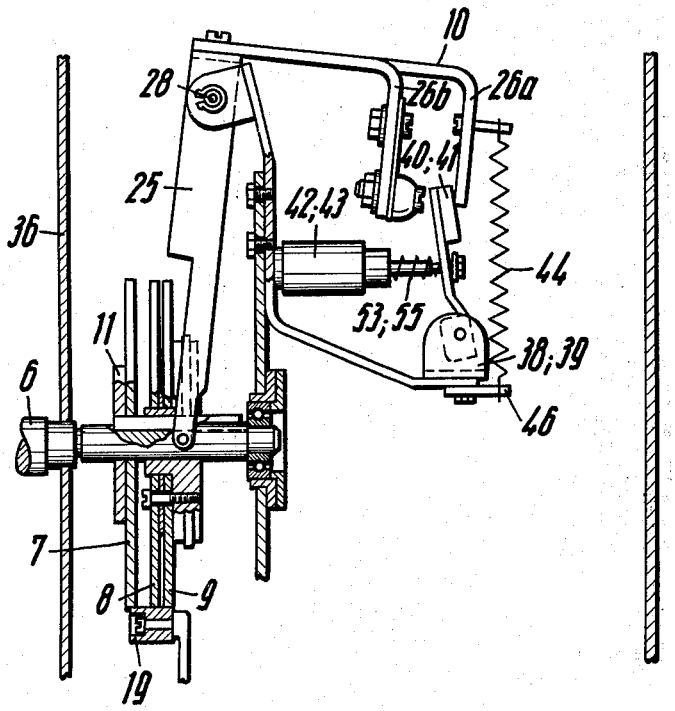
FIG. 4 is a view similar to FIG. 3 but illustrating the cams in a position which they assume when a first, second and third line are to be printed.

FIG. 4 shows that if the electromagnet 42 is energized in the same way as described above with respect to the electromagnet 43, it will displace the abutment 40 so that the device 10 can pivot further towards the abutments 40, 41 which are now in alignment. This causes the cam 9 to be moved into engagement with the cam follower roller 19 and sets the third printing line for the printing operation.

After the printing operation has been completed the cams 8 and 9 are moved out of engagement with the cam follower roller 19. This takes place as the shaft 48, which rotates synchronously with the printing roller 1, engages with its projection 49 the roller 47 which projects somewhat from the portion **46*b*, and thus lifts the device 10 off the abutments 40, 41. At this time the electromagnets 42 and 43 have already been de-energized so that they no longer displace the abutments and the latter can therefore be returned to their starting position (shown in FIG. 1) by the associated springs 53, 55 opposite to the previously identified direction A. Thus, the device 10 is again moved with its portion 26*a'* against the abutment 41 under the urging of the spring 44.**

Figure 5:
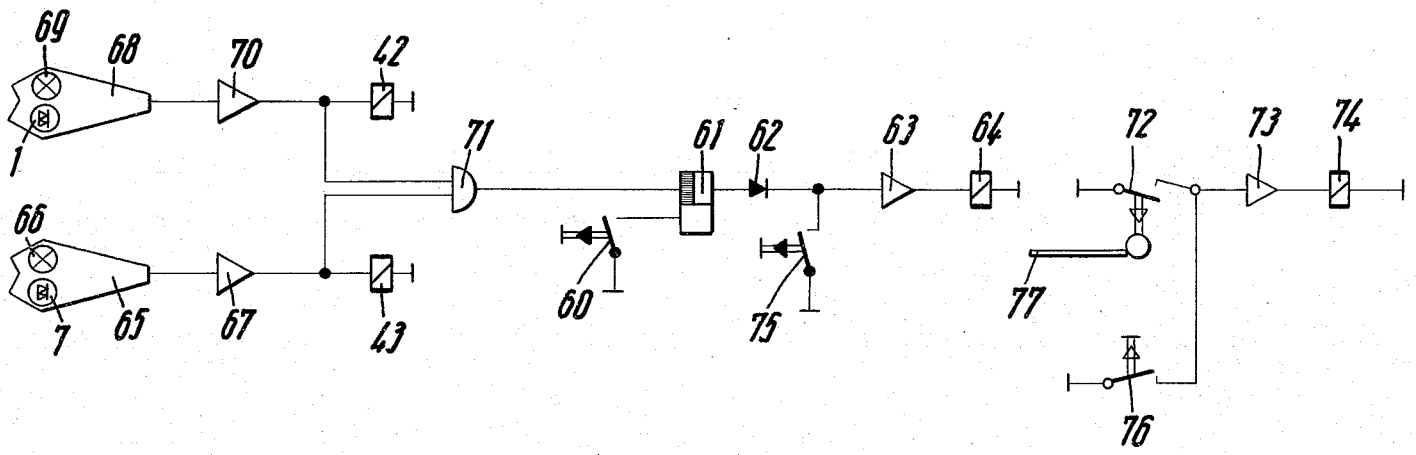
FIG. 5 is a circuit diagram of the circuit controlling the operation of the machine in FIGS. 1–4.

Coming now to FIG. 5 it will be seen that this is a diagram showing the connection of various components of the apparatus in FIGS. 1–4. With respect to FIG. 5 it will now be explained how the device 51 in conjunction with the magnets 42 and 43 cooperates for moving the cams 8 and 9 into and out of engagement with the cam follower roller 19, by way of the device 10.

The printing form 2 is mounted on the printing roller 1, as shown in FIG. 1. It is provided with the markings or indicia 2*a* which are intended to be scanned and, when detected, to trigger printing of the second and third lines on the printing form. To start the machine a switch 60 is closed, resulting in rotation of the printing roller 1. At the same time, the switch 26 energizes a bistable multivibrator 61 and a diode 62 which supply a signal to an amplifier 63 whereupon the latter energizes a magnetic coupling 64 to start a device for supplying copy sheets to the roller 1. This latter device is already known and may for instance be of the type shown in U.S. Pat. No. 3,156,182.

The device 51 has, in this embodiment, two reading heads 65 and 68. If the head 65 scans an indicium provided for this purpose on the printing form, then the light beams emitted by the light source 66 of head 65 are darkened, so that only a portion of the reflected beams will be received by a photoelectric cell of the head 65. The result of this is known, namely a potential difference develops which produces a signal that is amplified in an amplifier 67 which is then used to energize the electromagnet 43. The results in displacement of the abutment 41 and the movement of the cam 8 into engagement with the cam follower roller 19 to thereby cause printing of the second printing line.

In the same manner as just described, the movement of the cam 6 into contact with the cam follower roller 19 is effected, in order to cause printing of the first printing line. For this purpose the head 68 reads the indicia 2*a* on the printing form 2, resulting in a darkening of the light beams of a source 69 so that only a portion of the reflected beams is received by the photoelectric cell of the head 68. The potential difference which develops as a result of this is supplied to an amplifier 70 which thereupon energizes the electromagnet 42.

If both of the heads 65 and 68 detect and indicium 2*a* at one and the same time, then the magnets 42 and 43 are both energized via the respective amplifiers 67 and 70. This will result in supply of a signal to an AND-gate 71 which returns the bistable multivibrator to its starting position, with the result that the magnetic coupling 64 is deenergized and the rotary duplicating machine is shut down.

The copy sheet feeding device may initiate the operation of the rotary duplicating machine by feeding to the latter a punched card 77 which then closes a switch 72 via an amplifier 73 actuates a starting electromagnet 74. A switch 75 permits the sheet-feeding device to be switched on manually via the amplifier 63 and the magnetic coupling 64. A switch 76 permits manual starting-up of the rotation of the rotary printing roller 1, via the amplifier 73 and the magnet 74.

To summarize the purpose of the indicia 2*a* on printing form 2: if a line 2*b* is found by the device 51 not to have any indicia 2*a*, the cams 8, 9 remain stationary. If a line 2*b* is found to have a single indicium 2*a*, the signal resulting from detection of this indicium causes the cam to be moved into a position where it can be engaged by the roller 19; should the line 2*b* be found to have two of the indicia 2*a* which are spaced from one another lengthwise of the form 2 (left to right in FIG. 6), then both of the cams 8, 9 are moved to this position. When the device 51 detects a line 2*b* having two indicia located laterally adjacent one another, i.e., the last (right-hand) line in FIG. 6, this results in generation of a signal that shuts down the machine, as described above with reference to FIG. 5.

It will be appreciated that each of the elements described above, or two or more together, may also find a useful application in other types of constructions differing from the types described above.

While the invention has been illustrated and described with reference to a rotary duplicating machine, it is not intended to be limited to the details shown, since various modifications and structural changes may be made without departing in any way from the spirit or concept of the present invention.

Without further analysis, the foregoing will so fully reveal the gist of the present invention that others can by applying current knowledge readily adapt it for various applications without omitting essential features of the generic or specific aspects of the invention and, therefore, such modifications and adaptations should and are intended to be comprehended within the meaning and range of equivalence of the following claims.

What is claimed as new and desired to be protected by Letters Patent is set forth in the appended claims.

1. In a rotary duplicating machine, a combination comprising rotary printing roller means supporting a printing form provided with first and second triggering indicia associated with respective printing form sections which have different lengths, said printing roller means including means for detecting the respective indicia and for producing respective triggering signals in response to such detection; rotary counter-pressure roller means, one of said roller means being movable to and from a printing position in close proximity to the other roller means and defining with said other roller means a printing line through which said sections of said printing form must pass; operating means connected to said movable roller means for moving said movable roller means to and from said printing position; control means including a selectively associatable first cam and second cam, and means for selectively associating said first cam with said operating means to thereby move said movable roller means to said printing position in response to detection of one of said indicia and for a first time period the length of which depends upon the length of the one printing form section associated with said one indicium and during which first time period said printing roller means turns through a first angle corresponding to the length of said one printing form section, and for selectively associating said second cam with said operating means to thereby move said movable roller means to said printing position in response to detection of the other of said indicia and for a second time period the length of which depends upon the length of the other printing form section associated with said other indicium and during which second time period said printing roller means turns through a different second angle corresponding to the length of said other printing form section; cam actuating means associated with said control means and including spring means permanently urging said cams towards association with said operating means, abutment means movable to and from blocking positions blocking the movement of said cams into association with said operating means, and electromagnetic means responsive to said triggering signals to move said abutment means away from said blocking position so as to permit movement of the respective cams into association with said operating means; and restoring means for restoring said abutment means to said blocking positions and for moving said cams out of association with said operating means.

2. A machine as defined in claim 1; and further comprising means operatively associated with said control means and said detecting means for operating said detecting means during each revolution of said printing roller means only while a printing form section having a selected length passes through said printing line.

3. A machine as defined in claim 1, wherein said control means comprises a shaft extending parallel to the axis of rotation of said printing roller means and on which said cams are axially shiftably mounted; said actuating means including a turnably mounted element having a free end portion, said abutment means being turnably mounted on said free end portion and comprising at least a first and successive second abutment arranged to permit sequentially greater turning of said element in on direction in response to displacement of the successive abutments from the respective blocking positions.

4. A machine as defined in claim 3, said free end portion carrying a roller arm; and wherein said restoring means comprises a cam projecting rotating in synchronism with said printing roller means and adapted to engage said roller arm and effect turning of said element in a direction opposite to said one direction, to thereby move said cams out of association with said operating means.

* * * * *